US005909738A

United States Patent [19]

Quennessen

[11] Patent Number: 5,909,738

[45] Date of Patent: Jun. 8, 1999

[54] METHOD FOR SEALING A HOUSING AND CORRESPONDING HOUSING

[75] Inventor: Bernard Quennessen, Whippani, N.J.

[73] Assignee: Qualipac, Neuilly Sur Seine, France

[21] Appl. No.: 08/875,878

[22] PCT Filed: Jan. 27, 1997

[86] PCT No.: PCT/FR97/00156

§ 371 Date: Aug. 6, 1997

§ 102(e) Date: Aug. 6, 1997

[87] PCT Pub. No.: WO97/27777

PCT Pub. Date: Aug. 7, 1997

[30] Foreign Application Priority Data

Jan. 30, 1996 [FR] France ..... 96 01086

[51] Int. Cl.[6] ..... A45D 33/00

[52] U.S. Cl. ..... 132/293; 132/294; 206/DIG. 26

[58] Field of Search ..... 132/293, 294, 132/295, 298, 299, 303, 300; 220/344, 233, 526, DIG. 26; 206/235, 581, 823

[56] References Cited

U.S. PATENT DOCUMENTS

| | | | |
|---|---|---|---|
| 1,672,417 | 6/1928 | Leberman | 132/293 |
| 1,818,409 | 8/1931 | Leberman . | |
| 1,968,177 | 7/1934 | Shepherd et al. | 132/294 |
| 2,033,295 | 3/1936 | Parkin | 132/293 |
| 2,054,004 | 9/1936 | Sandberg | 132/293 |
| 2,182,040 | 12/1939 | Swanson . | |
| 2,294,257 | 8/1942 | Udvarhely et al. | 206/235 |
| 4,589,519 | 5/1986 | Seidler . | |
| 5,356,025 | 10/1994 | Renault | 206/581 |

FOREIGN PATENT DOCUMENTS

| | | | |
|---|---|---|---|
| 614629 | 9/1994 | European Pat. Off. . | |
| 737089 | 12/1932 | France . | |
| 376875 | 7/1932 | United Kingdom | 206/DIG. 26 |
| 87 07 483 | 12/1987 | WIPO . | |

*Primary Examiner*—Todd E. Manahan
*Attorney, Agent, or Firm*—Rothwell Figg Ernst & Kurz

[57] ABSTRACT

The case comprising a base (2) and a lid (3) articulated thereon includes a container (5) which can receive, for example, a more or less volatile cosmetic product which may deteriorate in contact with the ambient air. According to the invention, the case comprises a mechanism (6) enabling the container (5) to be raised when the case is closed, while ensuring sealing contact between an upper wall (15) of the container and a cooperating wall (16) of the lid. The invention can be applied especially to make-up cases.

17 Claims, 3 Drawing Sheets

METHOD FOR SEALING A HOUSING AND CORRESPONDING HOUSING

Figure 1:
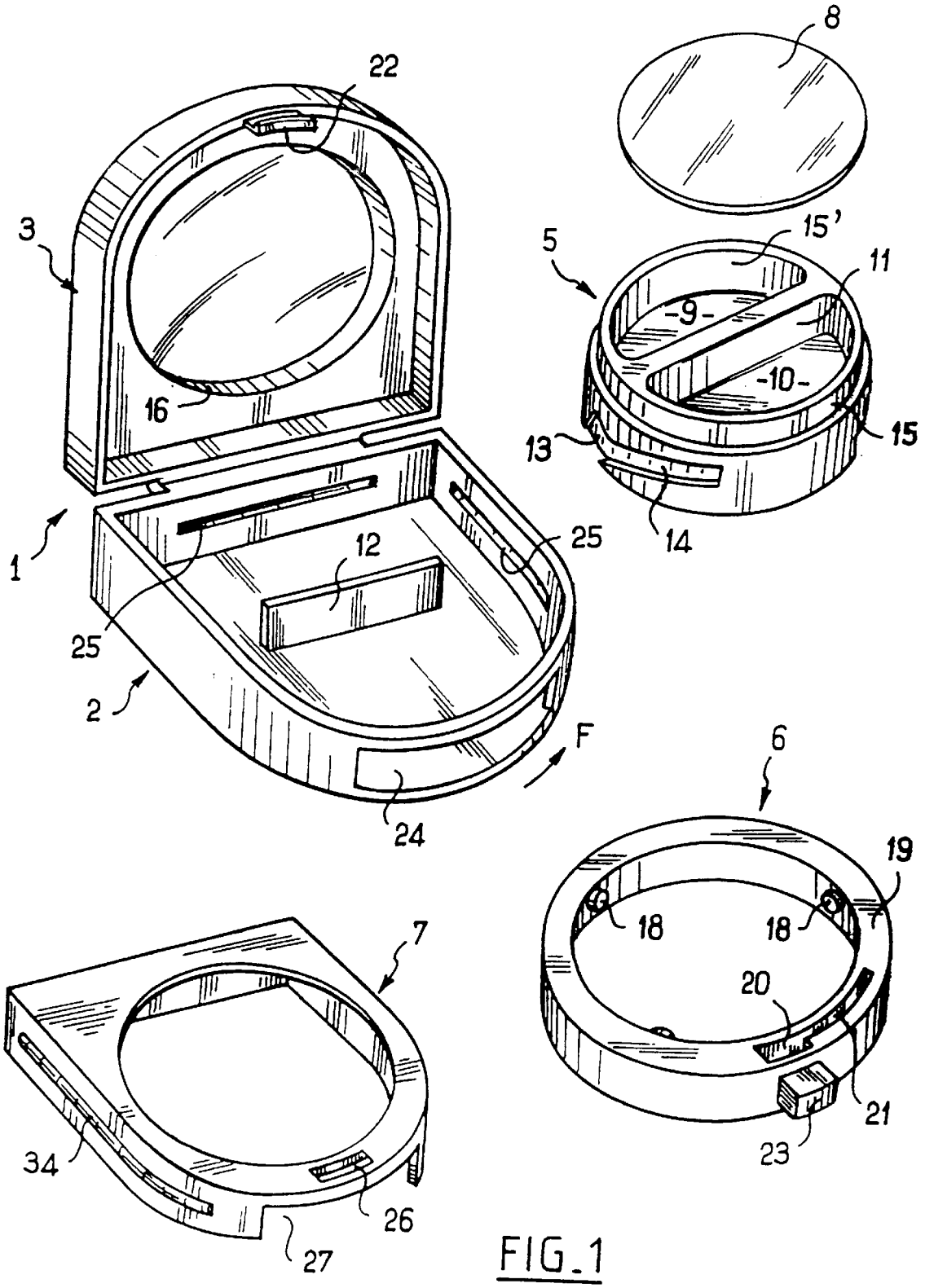

The present invention relates to a method of sealingly closing a case, particularly for cosmetic products, such as a make-up case, and also a corresponding improved case ensuring completely sealed closure.

In particular, make-up cases are known which are composed basically of a base and a lid articulated thereon which can be locked on the base.

The case receives a container on its base, the container being intended to contain a more or less volatile make-up product which may also deteriorate in contact with the ambient air.

The problem posed and which the invention aims to solve is that the lid does not ensure sealed closure to the air and to gas in cooperation with the case, so that the product contained in the case deteriorates, either as a result of the evaporation of its volatile components or, for example, as a result of oxidation by the air and/or humidification.

At present it is not known how to obtain sealed closure of a lid which is simply folded down onto the base of a case and which is held closed, for example, by a hook.

The method of the invention enables this problem to be solved by providing on the lid a means forming a substantially cylindrical skirt which can bear sealingly against an upper wall portion of the container, which contains the product, when the container is raised relative to the base, and by providing means for raising the container in the case when the lid has been closed on the base.

Advantageously, means are provided for first locking the lid on its base automatically in a first stage of operation of the case and then raising the container relative to the base in a second stage.

It will be appreciated that it is thus effectively possible to obtain a completely sealed closure owing to the cooperating bearing of the cylindrical skirt of the lid and the cooperating upper wall portion of the container when the container is raised against the lid.

The case according to the invention thus advantageously comprises:

formed on the lid, a means forming a substantially cylindrical skirt having a generatrix directed substantially perpendicularly to the general plane of the lid, formed on the container, an upper wall portion forming a substantially cylindrical complementary skirt which can cooperate with the skirt of the lid by coming into close contact therewith, at least one means enabling the container to be raised relative to the base of the case after the lid has been closed on the base of the case.

It will be appreciated that, with the means of the invention, it is relatively easy to obtain a closure which is completely sealed against gas and air between two substantially cylindrical cooperating complementary walls, also selecting in an appropriate manner the materials which will constitute those two walls, for example ABS (acrylonitrile butadiene styrene) for the case and polypropylene (PP) for the container.

Other features, aims and advantages of the present invention will be explained more clearly by means of the following description which is given with reference to the appended drawings showing a preferred embodiment by way of example.

In the drawings:

FIG. 1 is an exploded perspective diagrammatic view of a complete device forming a make-up case according to the invention.

Figure 2:
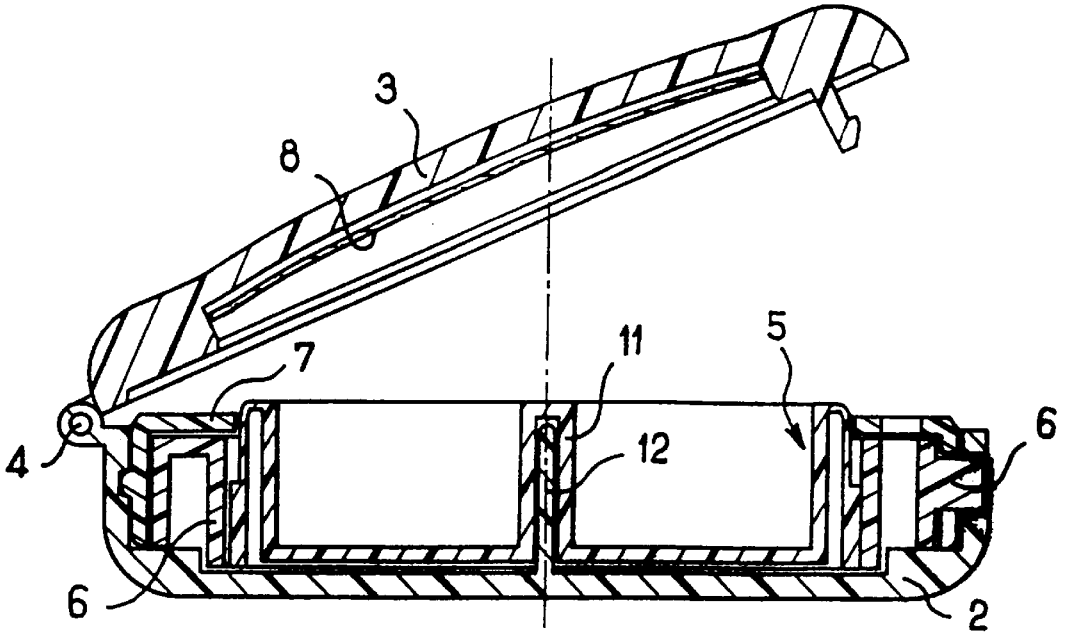
Figure 3:
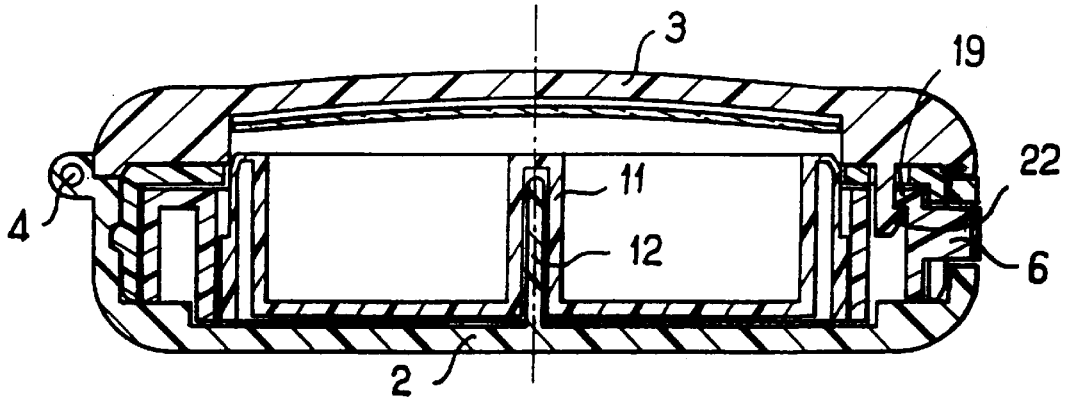
Figure 4:
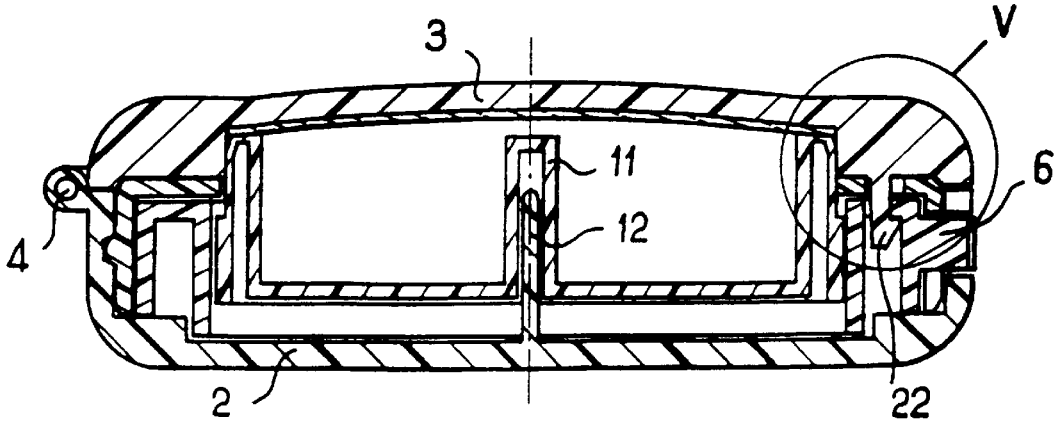

FIGS. 2, 3 and 4 are diametral sectional views of the assembled device, these views being in a plane perpendicular to the axis of articulation of the lid on its base; FIG. 2 showing the case with the lid half-open, FIG. 3 showing the same case with the lid closed on the base, and the case not yet being locked sealingly, and FIG. 4 showing the position of the various components of the device after sealed locking of the case.

Figure 5:
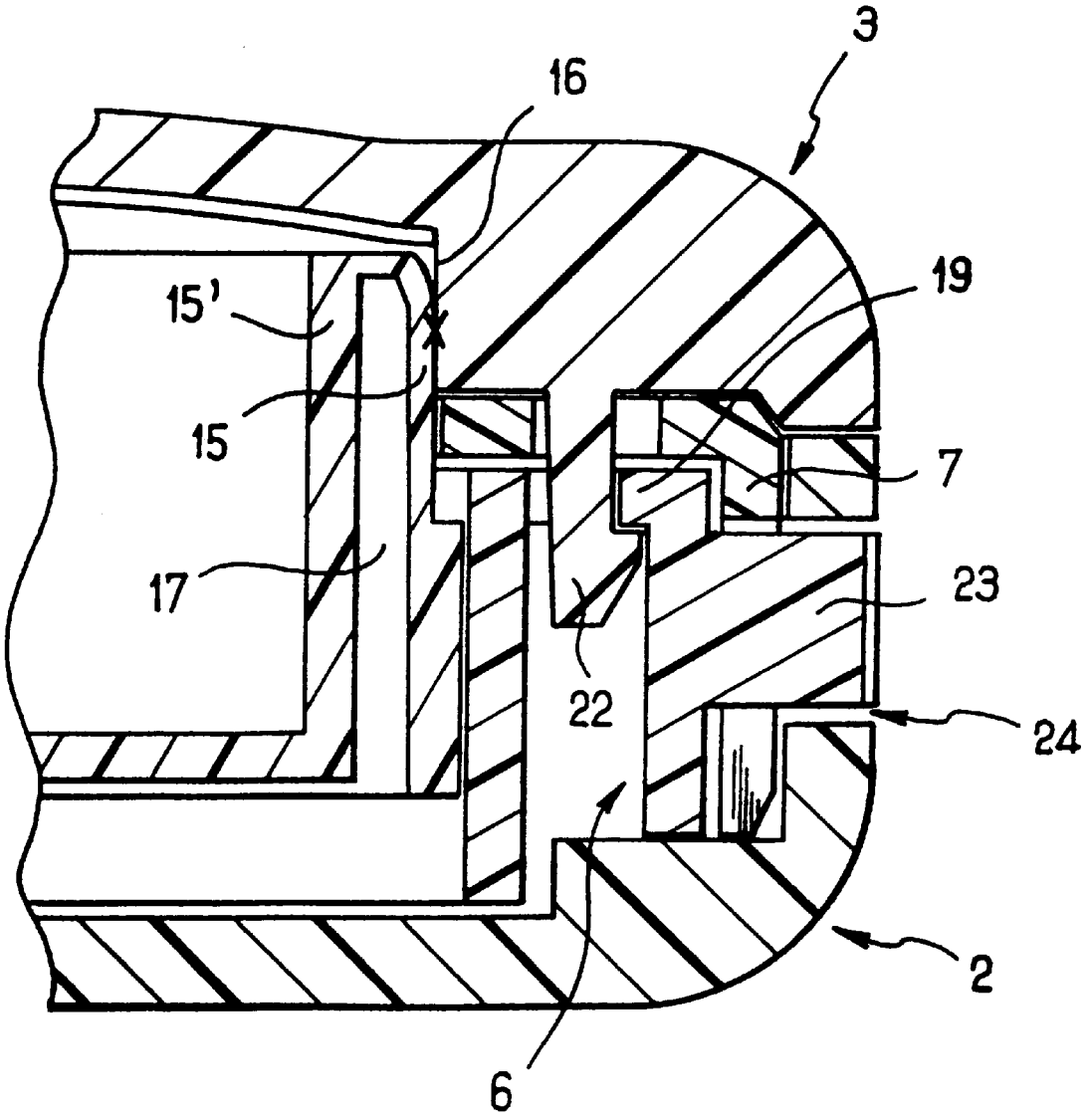

FIG. 5 is an enlarged view of the encircled detail V in FIG. 4.

With reference to the figures, in which the same reference numerals mark identical components, the following components, especially, can be seen: the case 1 formed by its base 2 on which the lid 3 is articulated about a hinge axis 4, a container 5 that is to contain the product accommodated in the case, a component 6 in the form of a ring which enables the container 5 to be raised and lowered as will be explained in detail hereinafter, a component 7 forming an ornamental plate hiding the operating mechanism of the device, and a mirror 8 adhesively bonded under the surface of the lid.

In the example illustrated, the container 5 is divided into two compartments 9 and 10, respectively, by a hollow transverse wall 11, as can be seen more clearly in FIGS. 2 to 4, this wall straddling a tongue 12 which rises perpendicularly from the base 2 of the case and which is advantageously produced from the same material as a result of being moulded in one piece with the base 2, advantageously from ABS, as already mentioned.

The lid 3 is also advantageously produced from the same material, this plastics material having a high degree of resistance to shock and having an attractive appearance.

Formed on the lower portion of the container 5 (see FIG. 1) are ramps, of which there are advantageously three and which are arranged at 120° to one another all round the container and one of which is clearly visible in FIG. 1.

The ramp forming a cam path for cams which will be described hereinafter comprises a starting portion 13 which is substantially horizontal, in other words parallel to the base of the container, and which is extended by a rising portion 14.

A skirt marked 15, which is inset slightly in the example illustrated and which is substantially circular-cylindrical in the example illustrated, is formed in the upper portion of the container.

The skirt 15 has a diameter corresponding externally to the inside diameter of a cooperating skirt 16 provided on the lid. As can be seen more clearly in FIG. 5, the skirt 15 in the example illustrated is formed by two walls 15, 15' leaving a hollow 17 between them, the bowl constituting the container 5 thus being very flexible and advantageously being moulded from polypropylene as indicated above.

For better sealing cooperation between the wall 15 of the container 5 and the wall 16 of the lid, it is possible to provide a slight conicity in the cooperating cylindrical parts.

In the embodiment illustrated, the ring 6 which, as will be explained hereinafter in connection with the operation of the device, provides for the raising and lowering of the container 5 in the closed case, comprises on its internal face three pins, forming cams 18, which are also distributed at 120° all round the ring and which engage in the above-described cam paths 13, 14 formed in the wall 15 of the container 5. The ring 6 also comprises on its upper face 19, which is in the form of a thin wall, a circular slot having, initially, a widened portion 20 into which the hook, marked 22, for locking the lid can penetrate, the remainder of the slot, marked 21, of narrower width, being capable of retaining the hook 22 when the hook is engaged under the ring, as can be seen more clearly in FIGS. 3 to 5.

The ring 6 also comprises an operating button 23 which is accessible on the periphery of the case, owing to a recess 24 formed for that purpose on the base of the case, and which enables the ring to be rotated through a predetermined angle in alternate senses.

As regards the plate 7, FIG. 1 shows that it comprises a specific number of recesses or hollow parts, such as those shown at 34, which are to lock on corresponding cooperating ribs, such as those shown at 25, which project from the base 2 of the case.

The component 7 is advantageously produced from a flexible plastics material, such as, for example, polypropylene.

The component 7 also comprises passages of suitable dimensions formed on its top wall, as marked at 26, to permit the passage of the hook 22 of the lid, and on the front as marked at 27 to permit the passage of the operating button 23 of the ring 6.

The operation of the device described above will now be explained.

First of all, the case components are assembled by proceeding, for example, in the following order: the ring 6 is positioned by its lugs 18 in the ramps 13 of the container 5, then the whole is slid into the base 2 of the case which may have previously been equipped with its lid 3 articulated about its hinge 4.

The hollow wall 11 straddles the tongue 12, preventing any rotation of the container 5 in the case.

During assembly, care has been taken to cause the operating button 23 to pass out through the slot 24 provided on the front of the base of the case.

The mirror 8 is adhesively bonded to the base of the lid before or after this assembly.

It is then necessary only to engage the plate 7 over the assembly, this simultaneously locking the container 5 in the base of the case by maintaining the ring 6 applied to the base of the case (see FIG. 5 especially).

Thereafter, if the ring 6 is rotated fully in the sense of arrow F inside the passage 24 formed on the front wall of the base 2, the hook 22 of the lid is positioned opposite the widened portion 20 which is open at the upper face 19 of the ring.

In this position, it is therefore possible to fold the lid 3 down onto the base 2, although this closure does not lock the lid on the base and a fortiori does not bring about the desired sealed closure of the container 5.

By rotating the ring 6, by means of its operating button 23, in the opposite sense to arrow F (opposite sense to that of the rotation of the hands of a watch) the hook 22 passes under the wall 19, penetrating into the narrow portion 21 of the slot, thus preventing the lid from being raised.

At the same time, the lugs 18 of the ring, which are engaged in the rising ramps 14, raise the container 5, which is prevented from rotating as a result of the fact that its wall 11 is straddling the tongue 12.

This raising operation is completely balanced because it is guided by the three lugs 18 rotating through the same angle in the three ramps 14 orientated in the same manner.

The wall 15 thus covers and bears sealingly against the wall 16 of the lid (see FIGS. 4 and 5), the small thickness of the resilient, flexible, hollow wall 15, against the rigid wall 16, ensuring complete sealing (especially in the area of the walls bearing against one another, as marked by a cross in FIG. 5).

The device is opened very simply by rotating the ring in the sense opposite to closure, still by actuation of the operating button 23, but this time in the sense of rotation of arrow F (FIG. 1).

It will be appreciated that numerous variants can be applied to the embodiment described.

Thus, in particular, although it has been provided that the sealed closure between the lid and the upper portion of the container be effected by a circular-cylindrical wall of the lid which grips round the outside of the cooperating circular-cylindrical portion of the container 5, it would be possible to provide for an opposite assembly in which a cylindrical wall of the lid penetrates into the inside of the corresponding upper cylindrical portion of the container.

In other words, the sealed joint could be produced on the side where the wall 15' is located rather than on the side where the wall 15 is located.

In the same manner, instead of rotating the ring 6 relative to the container 5, it could be provided that the container 5 be rotated relative to a ring 6 which has been immobilised against rotation.

Advantageously, the cooperating walls, such as 16, 15, for the sealed closure of the container may be provided with a certain conicity and resilience.

As regards the constitution of the components, they may be manufactured from various suitable materials; for example, the ring 6 could be a metal or plastics ring.

Although a description has been given of particular means having a rotating ring 6 for controlling the raising and lowering of the container 5, it will be appreciated that other means of raising the container could be provided ensuring an equivalent effect, for example, a means of pneumatic and/or electric raising by small jacks or small motors incorporated under the container.

I claim:

1. A case comprising:

a base;

a lid which is movable toward and away from said base and which can be locked onto the base;

a container which is received on the base and which contains a product;

a bottom of said lid having a size and shape corresponding to a top of said container and positioned so that when said lid is locked the top of said container can contact said bottom of said lid when said container is raised relative to said base and said lid;

positively actuable raising means for raising and lowering the container relative to the base and the lid.

2. The case according to claim 1, wherein the base comprises rotation prevention means for preventing rotation of the container relative to the base.

3. The case according to claim 2, wherein the means for preventing rotation of the container during translation is formed by a tongue which extends perpendicularly from the base of the case and which engages in a passage in the base of the container.

4. The case according to claim 1, wherein the raising means comprises:

a ring which can rotate in the base and which rests thereon and which further includes an operating button accessible on a periphery of the case, enabling the ring to be rotated back and forth through a predetermined angle;

cam means on an inner circumferential surface of the ring; and guide means formed on an outer circumferential surface of the container, with the cam means of the ring contacting the guide means of the container.

5. The case according to claim 4, wherein the cam means comprises on the internal wall of the ring at least three pins forming cams.

6. The case according to claim 5, wherein the cam paths comprise a starting portion which is substantially parallel to the base of the case and which is extended by a rising portion which ensures the progressive raising and lowering of the container during the relative rotation of the ring with respect to the container to obtain a sealed closure or an opening of the case, depending on the direction of rotation of the ring.

7. The case according to claim 4, wherein the ring comprises on an upper face an arcuate slot having a widened portion into which a hook for locking the lid can penetrate, and a narrower portion for retaining the hook when the ring has commenced rotation to lock the lid and to raise the container.

8. Case according to claim 4, characterised in that the guide means comprises at least three ramps which are formed on the outer circumferential surface of the container.

9. The case according to claim 1, wherein a plate is provided which covers the ring, with said plate capable of being locked onto the base and which contains on an upper face respective slots for the free movement of the hook and the operating button of the ring.

10. The case according to claim 1, wherein said product is a cosmetic product.

11. The case according to claim 1, wherein said product is volatile or deterioratable when in contact with ambient air.

12. A method of closing and opening a case, comprising the steps of:

closing a lid which is articulated upon a base;

locking said lid with respect to said base;

elevating a container inside said base so that an outer circumferential surface of said container bears sealingly against an inner circumferential surface of said lid;

lowering said container inside said base so that said outer circumferential surface of said container moves away from said inner circumferential surface of said lid;

unlocking said lid with respect to said base; and opening said lid.

13. The method of claim 12, wherein said outer circumferential surface of said container has a conicity and a resilience.

14. The method of claim 12, wherein said inner circumferential surface of said lid has a conicity and a resilience.

15. The method of claim 12, wherein said outer circumferential surface of said container comprises a substantially cylindrical skirt.

16. The method of claim 12, wherein the locking step further comprises trapping a wider portion of a hook extending from said lid by rotating a ring having a slot with wide and narrow portions, whereby said hook is trapped when said slot is rotated with respect to said hook from said wide portion to said narrow portion.

17. The method of claim 12, wherein the elevating step further comprises the steps of:

rotating a ring having cam lugs on an inner circumferential surface; and engaging said cam lugs in ramps formed in an outer circumferential surface of said container;

whereby said container is elevated when said ring is rotated with respect to said container.

* * * * *